US009475166B2

(12) United States Patent
Godeau et al.

(10) Patent No.: US 9,475,166 B2
(45) Date of Patent: Oct. 25, 2016

(54) METHOD FOR CUTTING-OUT A MULTI-LAYER OPHTHALMIC LENS

(71) Applicants: Muriel Godeau, Charenton le Pont (FR); Aude Lapprand, Charenton le Pont (FR); Cedric Lemaire, Charenton-le-Pont (FR); Christian Massart, Charenton-le-Pont (FR); Gilles Massey, Charenton-le-Pont (FR); Sebastien Pinault, Charenton-le-Pont (FR); Catherine Roussel, Charenton-le-Pont (FR); Montserrat Burgos, Charenton-le-Pont (FR)

(72) Inventors: Muriel Godeau, Charenton le Pont (FR); Aude Lapprand, Charenton le Pont (FR); Cedric Lemaire, Charenton-le-Pont (FR); Christian Massart, Charenton-le-Pont (FR); Gilles Massey, Charenton-le-Pont (FR); Sebastien Pinault, Charenton-le-Pont (FR); Catherine Roussel, Charenton-le-Pont (FR); Montserrat Burgos, Charenton-le-Pont (FR)

(73) Assignee: ESSILOR INTERNATIONAL (COMPAGNIE GENERALE D'OPTIQUE), Charenton le Pont (FR)

( * ) Notice: Subject to any disclaimer, the term of this patent is extended or adjusted under 35 U.S.C. 154(b) by 96 days.

(21) Appl. No.: 14/399,715

(22) PCT Filed: May 3, 2013

(86) PCT No.: PCT/FR2013/050988

§ 371 (c)(1),
(2) Date: Nov. 7, 2014

(87) PCT Pub. No.: WO2013/167831

PCT Pub. Date: Nov. 14, 2013

(65) Prior Publication Data

US 2015/0140905 A1 May 21, 2015

(30) Foreign Application Priority Data

May 9, 2012 (FR) ..... 12 01333

(51) Int. Cl.
*B24B 9/14* (2006.01)
*B24B 13/00* (2006.01)
(Continued)

(52) U.S. Cl.
CPC ..... *B24B 9/14* (2013.01); *B24B 9/146* (2013.01); *B24B 9/148* (2013.01); *B24B 13/0037* (2013.01); *B24B 27/0076* (2013.01); *B24D 3/00* (2013.01)

(58) Field of Classification Search
CPC ..... B24B 9/14; B24B 9/146; B24B 13/0037; B24B 13/0043; B24B 13/04; B24B 27/0076; B24D 3/00
See application file for complete search history.

(56) References Cited

U.S. PATENT DOCUMENTS 3,894,361 A * 7/1975 Georgiadis ..... B24B 9/14 451/240
3,922,821 A 12/1975 Canterbury
(Continued)

FOREIGN PATENT DOCUMENTS

CN 101443155 5/2009
FR 2 887 168 A1 12/2006
(Continued)

OTHER PUBLICATIONS

CN Office Action, dated Dec. 28, 2015; Application No. 201380023888.4.
(Continued)

*Primary Examiner* — Timothy V Eley
(74) *Attorney, Agent, or Firm* — Young & Thompson

(57) ABSTRACT

A method for cutting-out a multi-layer ophthalmic lens (100) following a desired contour (C3), includes: a step of pre-blanking the ophthalmic lens (100) using a preliminary tool (210; 223), according to a preliminary contour (C1, C1'); a step of blanking the ophthalmic lens (100) using a blanking wheel (210), following a blanking contour (C2, C3); and a step of finishing the ophthalmic lens (100) using a finishing tool (212). According to the invention, the preliminary contour (C1, C1') is larger than the desired contour (C3), and the blanking wheel (210) used has a granulometry of between 0.1 and 0.5 mm and is controlled in relation to the ophthalmic lens (100) so as to apply a radial force of between 0.1 and 5 N to the ophthalmic lens (100) during the blanking step.

11 Claims, 5 Drawing Sheets

(51) Int. Cl.
*B24B 27/00* (2006.01)
*B24D 3/00* (2006.01)

(56) References Cited

U.S. PATENT DOCUMENTS 6,074,280 A * 6/2000 Mizuno ..... B24B 9/14 451/42
6,123,606 A * 9/2000 Hill ..... B24B 1/00 451/178
8,926,401 B2 * 1/2015 Lemaire ..... B24B 9/14 451/43
8,931,899 B2 * 1/2015 Lemaire ..... B24B 49/16 351/159.73
2010/0009603 A1 * 1/2010 Nauche ..... B24B 9/14 451/43
2013/0095733 A1 4/2013 Lemaire et al.
2016/0031058 A1 * 2/2016 Daimaru ..... B24B 9/148 451/5

FOREIGN PATENT DOCUMENTS

FR 2 962 676 A1 1/2012
WO 2012/007654 A1 1/2012

OTHER PUBLICATIONS

International Search Report, dated Jun. 19, 2013, from corresponding PCT application.

* cited by examiner

METHOD FOR CUTTING-OUT A MULTI-LAYER OPHTHALMIC LENS

TECHNICAL FIELD OF THE INVENTION

Generally, the present invention relates to the preparation of multilayer ophthalmic lenses (i.e. lenses comprising a substrate and at least one coating film that is made from a material different from that of the substrate and that covers a main face of the substrate) with a view to fitting them in spectacle frames.

It more particularly relates to a process for trimming an ophthalmic lens along a desired outline, comprising:

- a step of pre-roughing the ophthalmic lens by means of a preliminary tool, along a preliminary outline separate and deduced from said desired outline;
- a step of roughing the ophthalmic lens by means of a roughing abrasive wheel, along a roughing outline coincident with or enlarged relative to the desired outline; and
- a step of finishing the ophthalmic lens by means of a finishing tool.

PRIOR ART

It is common to place on the substrate of an ophthalmic lens one or more coating layers taking the form of films.

Such a film may be used for various reasons, especially in order to increase the optical comfort of the ophthalmic lens or in order to improve the optical performance of the latter.

It may for example be a question of a film of micro-cells that makes it possible to provide the ophthalmic lens with properties of photochromism or index variation.

The drawback of such multilayer ophthalmic lenses is that in practice it proves to be difficult to trim them.

This is because the use of a conventional abrasive wheel, under standard trimming conditions and in the presence of a lubricant, weakens the ophthalmic lens or even causes debonding and/or delamination, i.e. separation of the various layers of the ophthalmic lens.

Thus, a trimming process such as defined in the introduction, which is especially intended for trimming multilayer ophthalmic lenses, is known from document FR 2 962 676.

The pre-roughing step of the trimming process that is described therein consists in cutting the lens by means of a cutter, through the thickness of the film only and along a preliminary outline shrunk relative to the desired outline. The roughing and finishing steps are for their part carried out in conventional ways using shaping abrasive wheels.

It will be understood that cutting the film prevents the useful portion of this film (located inside the preliminary outline) from being subjected to stresses during the operations of roughing and finishing the ophthalmic lens.

Unfortunately, the cutting of the film leads to, after the trimming of the lens, a track appearing that runs all the way along the edge of this lens.

This track proves to be particularly unattractive. Moreover, it is all the more unattractive if the film has a different color to that of the substrate. It may even generate optical effects that are unpleasant for the spectacle wearer.

The cutting of the film by the cutter furthermore generates waves along the edge of the film, thereby creating an equally unattractive serrated effect.

SUBJECT OF THE INVENTION

In order to remedy the aforementioned drawbacks of the prior art, the present invention proposes a refined process for trimming a multilayer ophthalmic lens.

More particularly, according to the invention a trimming process is provided such as defined in the introduction, in which process said preliminary outline is enlarged relative to the desired outline, and in which provision is made for the roughing abrasive wheel used to have a grain size comprised between 0.1 and 0.5 mm and for it to be steered relatively to the ophthalmic lens so as to apply in said roughing step a radial force to the ophthalmic lens comprised between 0.1 and 5 newtons.

Thus, the preliminary outline being enlarged relative to the desired outline, the finishing and roughing steps make it possible to remove the traces that the pre-roughing step could possibly have left on the ophthalmic lens.

Moreover, the Applicant has tested said combination of grain size and radial force used for roughing of the lens, and has thus been able to observe that it allows the stresses applied to the useful portion of the film of the lens to be decreased as well as possible and thus (with the pre-roughing step) any debonding and/or delamination of the film to be prevented.

The following are other advantageous and nonlimiting features of the trimming process according to the invention:

- said finishing tool used is an abrasive wheel having a grain size comprised between 0.02 and 0.1 mm, steered relatively to said ophthalmic lens along the desired outline, so as to apply in said finishing step a radial force to the ophthalmic lens comprised between 5 and 18 newtons;
- in said finishing step, said finishing tool is steered relatively to said ophthalmic lens in order to machine said ophthalmic lens in at least three passes;
- after said finishing step, a step of polishing said ophthalmic lens by means of a polishing tool is provided;
- said polishing tool used is an abrasive wheel having a grain size comprised between 0.0005 and 0.02 mm, steered relatively to said ophthalmic lens so as to apply in said polishing step a radial force to the ophthalmic lens comprised between 10 and 35 newtons;
- in said polishing step, said polishing tool is steered relatively to said ophthalmic lens in order to machine said ophthalmic lens in at least three passes;
- said preliminary tool being a cutter, said pre-roughing step consists in cutting the ophthalmic lens right through the thickness of the coating film and through only some of the thickness of the substrate, along the preliminary outline;
- the roughing outline is enlarged relative to the preliminary outline;
- said roughing step is carried out in the presence of a lubricant;
- said preliminary tool being the roughing abrasive wheel, said pre-roughing step is carried out in the presence of a lubricant, along the preliminary outline; and
- said roughing step is carried out dry, in the absence of lubricant, along the desired outline.

DETAILED DESCRIPTION OF AN EXAMPLE EMBODIMENT

The following description and the appended drawings to which it refers, which are given by way of nonlimiting examples, will allow what the invention consists of and how it can be carried out to be understood.

Figure 3A:
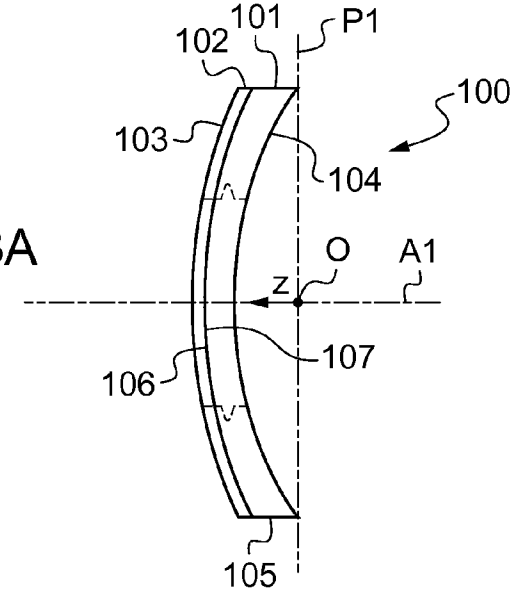
FIGS. 3A and 3B are side and front schematic views of an ophthalmic lens before trimming.
Figure 3B:
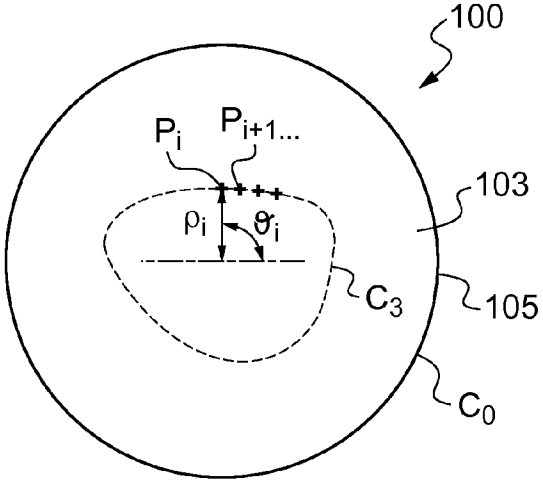
Figure 8A:
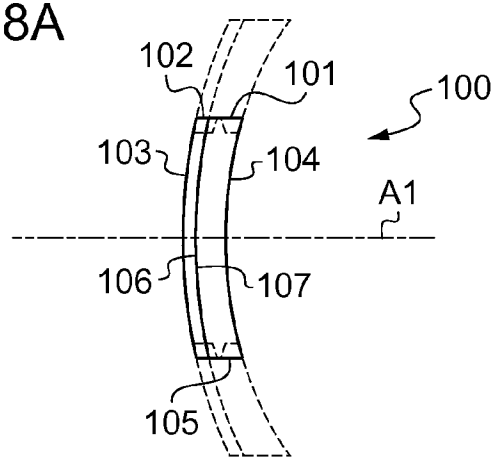
Figure 8B:
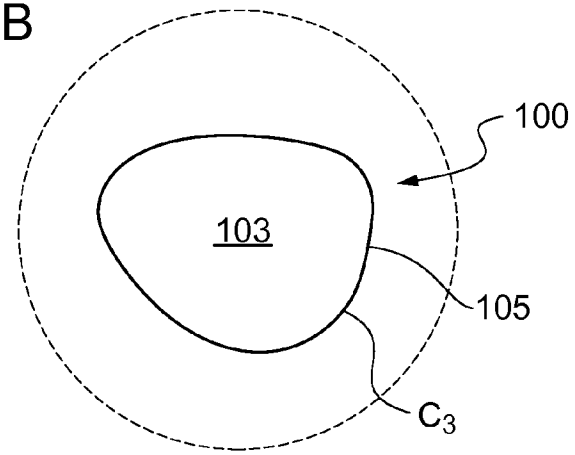
Figure 7A:
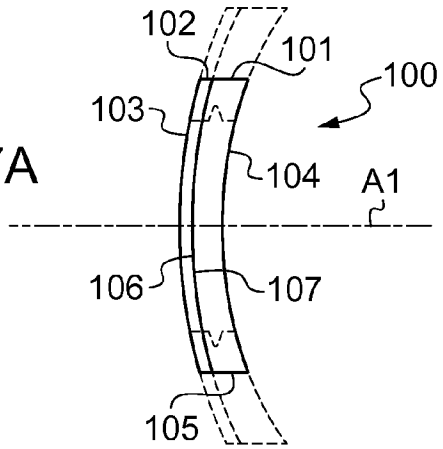
Figure 7B:
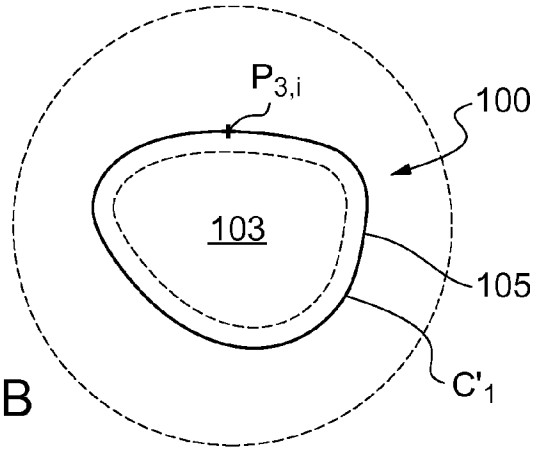

FIGS. 7A and 7B are side and front schematic views of the ophthalmic lens shown in FIGS. 3A and 3B, such as it is after a pre-roughing step carried out using a trimming process according to a second embodiment of the invention; and FIGS. 8A and 8B are side and front schematic views of the ophthalmic lens shown in FIGS. 7A and 7B, such as it is after a roughing step carried out according to the second embodiment of the trimming process according to the invention.

TRIMMING APPARATUS

Figure 1:
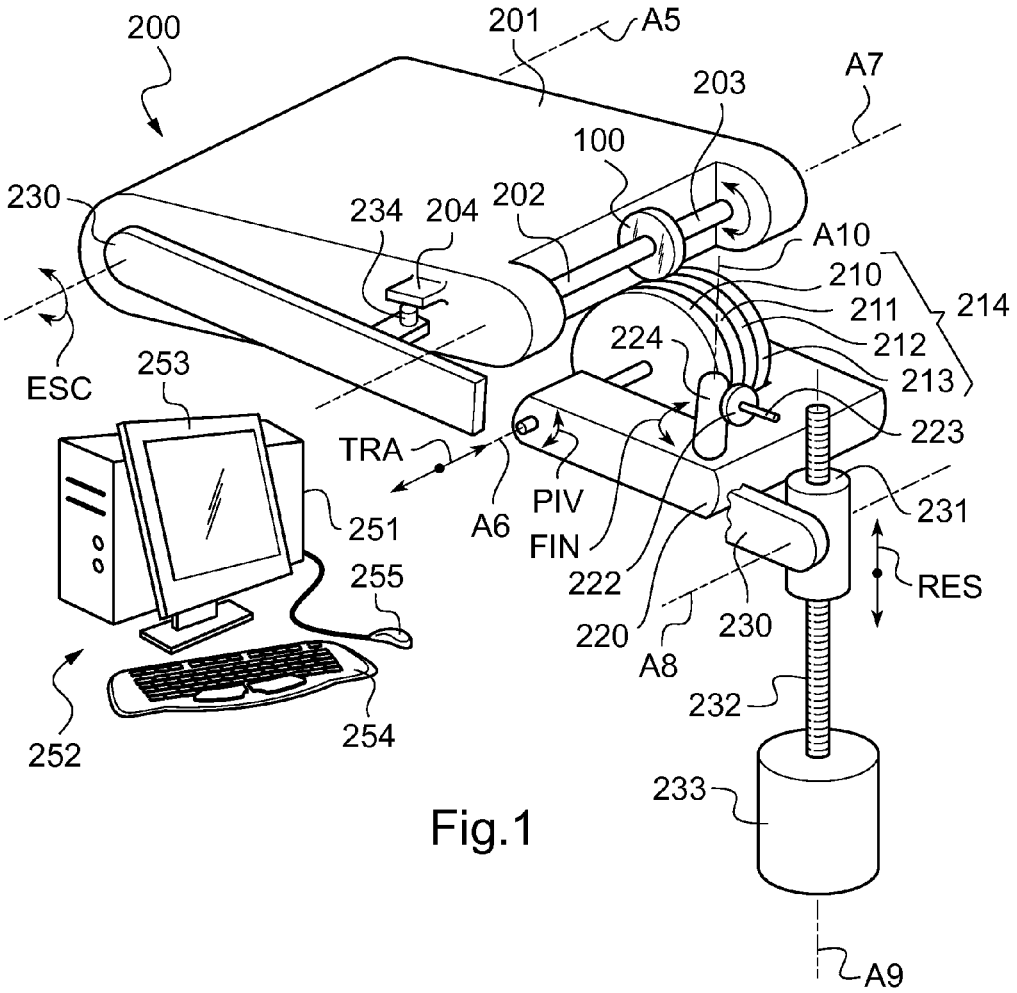
FIGS. 1 and 2 are schematic views of two embodiments of an apparatus for trimming ophthalmic lenses.
Figure 2:
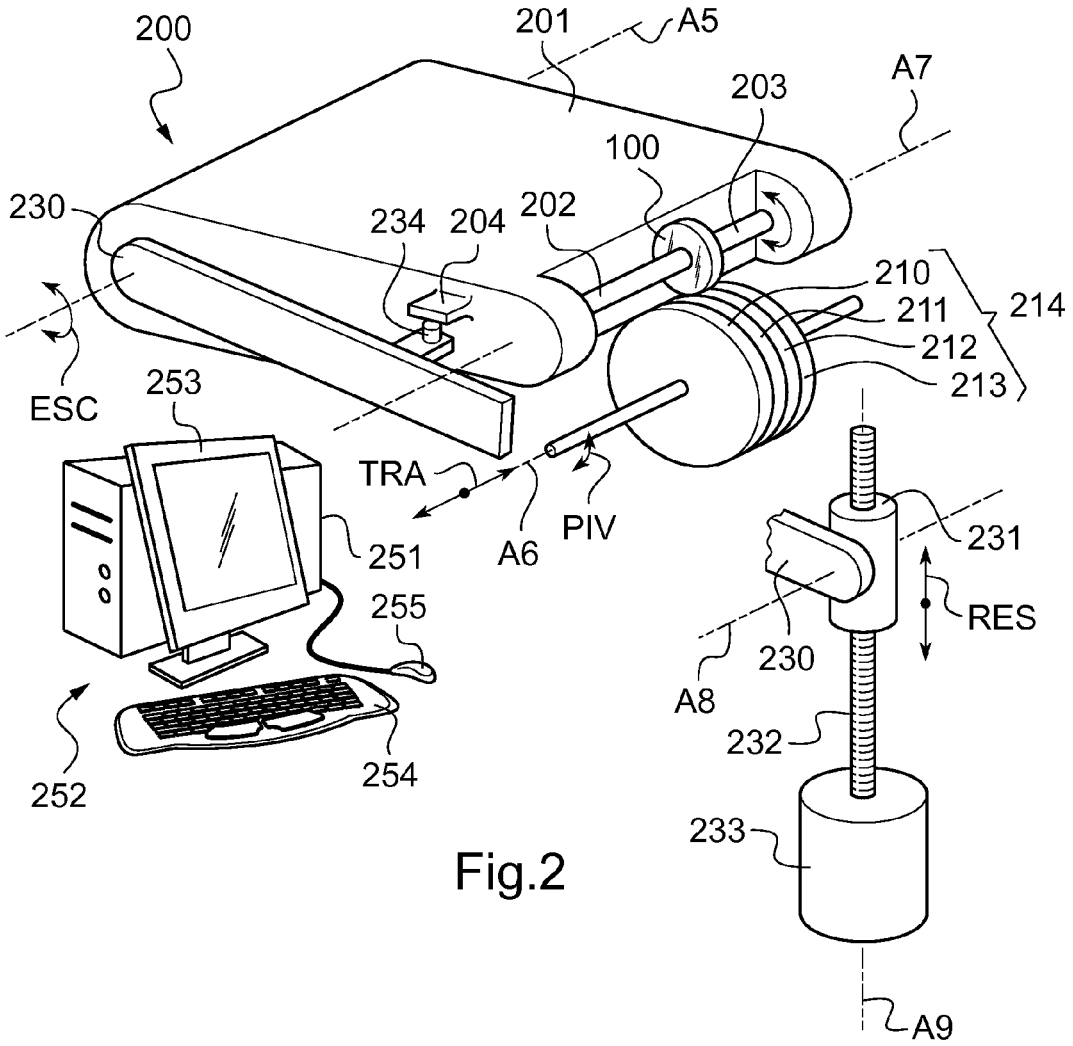

FIGS. 1 and 2 schematically show two embodiments of a trimming apparatus suitable for trimming an ophthalmic lens. These embodiments are given by way of illustration and other commercially available trimming apparatuses may be used to implement the present invention.

Such a trimming apparatus may take the form of any machine for cutting or removing material, able to modify the outline of the ophthalmic lens in order to match it to a frame selected by the future wearer of the pair of spectacles.

Such as schematically illustrated in FIG. 1, the trimming apparatus consists, as is known per se, of an automatic grinder 200, widely referred to as a digital grinder. In this case, this grinder comprises:

- a rocker 201 that is mounted so as to freely pivot about a reference axis A5, in practice a horizontal axis, on a mounting (not shown), and that supports the ophthalmic lens 100 to be machined;
- a bank 214 of abrasive wheels that is secured against rotation on an abrasive-wheel axis A6 parallel to the reference axis A5, and that is also duly driven to rotate by a motor (not shown); and
- a finishing module 220 that is fitted so as to rotate about the abrasive-wheel axis A6, and that is especially equipped with tools for finishing the ophthalmic lens 100.

The rocker 201 is equipped with a lens holder, here formed by two shafts 202, 203 for clamping the ophthalmic lens 100 to be machined and for driving it in rotation.

These two shafts 202, 203 are aligned with each other along a clamping axis A7 parallel to the axis A5. Each of the shafts 202, 203 possesses a free end that faces the other and that is equipped with a head for clamping the ophthalmic lens 100.

A first 202 of the two shafts is fixed in translation along the clamping axis A7. In contrast, the second 203 of the two shafts is mobile in translation along the clamping axis A7 in order to allow the ophthalmic lens 100 to be compressively clamped axially between the two clamping heads.

The bank 214 of abrasive wheels here comprises four abrasive wheels 210, 211, 212, 213 fitted coaxially on the abrasive-wheel axis A6, said abrasive wheels each being designed for a specific operation of machining the ophthalmic lens 100.

The bank 214 of abrasive wheels here in particular comprises a cylindrical roughing abrasive wheel 210 that is axisymmetric about the abrasive-wheel axis A6. This roughing abrasive wheel 210 comprises diamonds the grain size of which is comprised between 0.1 and 0.5 mm and here is equal to 0.3 mm.

The bank 214 of abrasive wheels also comprises a beveling abrasive wheel 211, referred to as a shaping abrasive wheel. This beveling abrasive wheel 211 has an overall cylindrical shape that is axisymmetric about the abrasive-wheel axis A6, however it contains a central furrow (not shown in the figures) that has a V-shaped cross section and that is axisymmetric about the abrasive-wheel axis A6. Thus, this central furrow allows a rib to be machined in the field of the ophthalmic lens 100 to be machined. This beveling abrasive wheel 211 comprises diamonds the grain size of which is comprised between 0.02 and 0.1 mm and here is equal to 0.06 mm.

The bank 214 of abrasive wheels lastly comprises two polishing abrasive wheels the shapes of which are identical to those of the roughing abrasive wheel 210 and beveling abrasive wheel 211, respectively, but the diamonds of which have grain sizes comprised between 0.0005 and 0.02 mm, here equal to 0.005 mm.

The bank 214 of abrasive wheels is born by a slide (not shown) mounted so as to be translationally movable along the abrasive-wheel axis A6. The translational movement of the slide bearing the abrasive wheels is called the "transfer" TRA.

It will be understood that here it is a question of producing a relative movement between the abrasive wheels and the lens and that provision could be made, as a variant, for the lens to be axially movable, the abrasive wheels remaining stationary.

The grinder 200 furthermore comprises a link rod 230 one end of which is hinged relative to the mounting in order to pivot about the reference axis A5, and the other end of which is hinged relative to a nut 231 in order to pivot about an axis A8 parallel to the reference axis A5.

The nut 231 is itself mounted to be translationally movable along a restitution axis A9 perpendicular to the reference axis A5. Such as schematically illustrated in FIG. 1, the nut 231 is a tapped nut in screwed engagement with a threaded shank 232 that, aligned with the restitution axis A9, is driven to rotate by a motor 233.

The link rod 230 moreover comprises a force sensor 234 that interacts with a corresponding element of the rocker 201. The pivoting angle of the link rod 230 about the reference angle A5 is then linearly associated with the vertical translation, denoted RES (for "restitution"), of the nut 231 along the restitution axis A9.

When, duly clamped between the two shafts 202, 203, the ophthalmic lens 100 to be machined is brought into contact with one of the abrasive wheels of the bank 214 of abrasive wheels, it is subjected to an effective removal of material. The radial force applied by the abrasive wheel to the ophthalmic lens may then be controlled with precision, by virtue of the force sensor 234.

To machine the ophthalmic lens 20 following a given outline, it is therefore enough, on the one hand, to appropriately move the nut 231 along the restitution axis A9, under the control of the motor 233, in order to control the restitution movement RES and, on the other hand, to make the supporting shafts 202, 203 pivot together about the clamping axis A7. The restitution movement of the rocker 201 and the rotational movement of the shafts 202, 203 are steered and coordinated by a controlling unit 251, duly programmed for this purpose, so that all the points of the outline of the ophthalmic lens 20 are, in succession, brought to the correct radius.

The finishing module 220 has a pivoting mobility about the abrasive-wheel axis A6, which pivoting mobility is denoted PIV. In fact, the finishing module 220 is provided with a toothed cog (not shown) that meshes with a pinion with which the shaft of an electric motor securely fastened to the slide bearing the abrasive wheels is equipped. This mobility allows it to be brought closer to or moved further away from the ophthalmic lens 100. The force and position of this electric motor are controlled in order to control with precision the force applied by the finishing tools to the ophthalmic lens 100.

The finishing module 220 is here equipped with a block 224 that holds the finishing tools and that is able to pivot about a finishing axis A10 orthogonal to the abrasive-wheel axis A6. This mobility, called the finishing mobility FIN, allows the finishing tools to be oriented relative to the lens 100. More precisely, here this block 224 holds a small disc-shaped grooving abrasive wheel 222 and a cutter 223, both driven in rotation about the same axis perpendicular to said finishing axis A10.

When, duly clamped between the two shafts 202, 203 the ophthalmic lens 100 is brought into contact with the cutter 223 or the small grooving abrasive wheel 222, it is also subjected to an effective removal of material.

To do this, the pivoting movement of the block 224, the pivoting movement of the finishing module 220, the restituting movement of the rocker 201 and the rotating movement of the shafts 202, 203 are then steered in coordination by the control unit 251.

This control unit 251 is of an electronic and/or information-processing type and in particular makes it possible to measure the radial force applied by the abrasive wheels and the finishing tools to the ophthalmic lens, and to control:

- the motor driving the translational movement of the second shaft 203;
- the motor driving the rotational movement of the two shafts 202, 203;
- the motor driving the translational movement of the slide bearing the abrasive wheels following its transfer mobility TRA;
- the motor 233 driving the translational movement of the nut 231 following its restitution mobility RES;
- the motor driving the rotational movement of the finishing module 220 following its retracting mobility ESC; and
- the motor driving the rotational movement of the block following its finishing mobility FIN.

Lastly, the grinder 200 comprises a human-machine interface 252 that here comprises a display screen 253, a keyboard 254 and a mouse 255, which are adapted to communicate with the controlling unit 251. This HMI 252 allows the user to input numerical values or to acquire various data taking the form of electronic files, in order to steer the grinder 200 in consequence.

FIG. 2 shows a second embodiment of this grinder 200.

In this embodiment, the grinder 200 has an identical architecture to that of the grinder shown in FIG. 1, the only difference being that it does not have a finishing module 200.

Ophthalmic Lens

FIGS. 3A and 3B show an ophthalmic lens 100 that has yet to be trimmed, the lens being of any type (convergent, divergent, non-correcting, etc.).

As FIG. 3A clearly shows, this ophthalmic lens 100 is a multilayer lens insofar as it comprises a substrate 101 and a coating film 102 that covers the substrate 101.

The substrate 101 is made of a first material, for example of mineral glass or organic glass, i.e. of a polymer.

It has two main faces 104, 106 namely a back face 104 that is intended to be turned toward the eye of the wearer, and a front face 106 opposite.

As for the coating film 102, it is designed to have defined physico-chemical or optical properties, such as for example reflective properties, hydrophobic properties, birefringent properties, polarization properties or absorption properties in certain wavelength ranges such as in the ultraviolet or at certain visible wavelengths so as to give the lenses a particular tint, or even anti-shock properties, anti-scratch properties and/or anti-reflection or anti-smudging properties.

The film 102 may be composed of a single layer, or of a plurality of coating layers having different properties.

Whatever the case may be, it is made from a different material from that of the substrate 101. This material is preferably a plastic and transparent.

For its part, the film 102 also has two main faces 103, 107, namely a back face 107 that is intended to be turned toward the eye of the wearer, and a front face 103 opposite.

This film 102 is fixed via its back face 107 to the front face 106 of the substrate 101, for example by adhesive bonding.

The back face 104 of the substrate 101 therefore forms the back face of the ophthalmic lens 100, whereas the front face 103 of the film 102 forms the front face of the ophthalmic lens 100. The edge faces of the substrate 101 and of the film 102 together form the edge face 105 of the ophthalmic lens 100.

A midplane P1 is defined, relative to the ophthalmic lens 100, as being the plane passing through the peripheral edge of the back face 104 of the ophthalmic lens 100. A central axis A1 is also defined as being that axis orthogonal to the midplane P1 which passes through the center of the back face 104 of the ophthalmic lens 100.

Lastly, an orthonormal/cylindrical coordinate system (O, $\rho$, $\theta$, Z) is defined attached to the ophthalmic lens 100, the origin O of which corresponds to the intersection of the midplane P1 and of the central axis A1, and the third dimension Z of which quantifies the height of points of the lens relative to the midplane P1.

Spectacle Frame

This ophthalmic lens 100 is intended to be trimmed so that its outline matches the shape of the spectacle frame selected by the wearer.

There are three main categories of spectacle frame from which the wearer may make their selection. These categories include full-rimmed spectacle frames, half-rimmed spectacle frames and rimless spectacle frames.

Full-rimmed spectacle frames conventionally comprise two rims that are each intended to receive a trimmed ophthalmic lens. These two rims are connected to each other by a bridge and each bears a temple. Each rim contains a groove, commonly referred to as a bezel, that runs along its interior face.

When the selected spectacle frame is a full-rimmed frame, the ophthalmic lens 100 must be trimmed so as to exhibit along its edge face 105 a fitting rib 109 (see FIG. 6A), commonly referred to as a bevel, which here has a V-shaped cross section. The bevel 109 thus formed on the edge face 105 of the lens 100 is then able to fit into the bezel of the full-rimmed frame.

Half-rimmed spectacle frames comprise two half-rims on the interior faces of which extend ribs, and two maintaining threads that are connected to the ends of the half-rims in order to form with the latter closed outlines.

When the selected spectacle frame is a half-rimmed frame, the ophthalmic lens 100 must be trimmed so as to exhibit recessed along its edge face 105 a peripheral groove. The lens is then held in place in the spectacle frame by fitting the upper portion of its edge face into the groove provided along the internal face of the corresponding half-rim, and by engaging the maintaining thread into the groove.

Lastly, rimless spectacle frames comprise two temples and a bridge, but no rims or half-rims. These temples and this bridge are in contrast equipped with pins designed to be inserted into holes drilled beforehand into the ophthalmic lenses.

When the selected spectacle frame is a half-rimmed frame, the ophthalmic lens 100 must be trimmed so as to exhibit an edge face 105 the cross section of which is straight, then drilled so that it is possible to securely fasten thereto the bridge and the corresponding temple of the spectacle frame.

Trimming Process

As FIG. 2 clearly shows, before trimming, the ophthalmic lens 100 has a circular initial outline Co.

In order to match the shape of the spectacle frame chosen by the future spectacle wearer, the ophthalmic lens 100 must then be trimmed along a desired outline C3.

In the case shown in the figures, in which the spectacle frame selected is a full-rimmed frame, this desired outline C3 corresponds to the closed curve along which it is desired to trim the crest of the bevel 109 of the ophthalmic lens 100, such that the latter fits perfectly in the corresponding rim of the spectacle frame.

In the case where the spectacle frame is half-rimmed or rimless, this desired outline corresponds to the closed curve along which it is desired to trim the edge face of the lens.

Whatever the case may be, the geometry and the position of this desired outline C3 relative to the ophthalmic lens are generally obtained in two operations referred to as the:

i) reading operation, in which the geometry of the outline that the ophthalmic lens 100 must have in order to be assembled in the selected spectacle frame is determined from the spectacle frame or from one of the demonstration lenses of this frame; and ii) centering operation, in which this desired outline C3 is suitably positioned and oriented in the frame of reference of the lens so that, once fitted in its frame, this lens is correctly positioned relative to the corresponding eye of the wearer, in order to allow it to exercise as well as possible the optical function for which it was designed.

Since these two operations are well known in the art, they will not be described in further detail here.

They allow a set of N triplets corresponding to the coordinates of a set of points $P_i$ characterizing the shape of the desired outline to be obtained, said coordinates being expressed in the frame of reference of the ophthalmic lens.

The coordinates of each of these points $P_i$ in the cylindrical coordinate system (O, ρ, θ, Z) are here denoted $\rho_i$, $\theta_i$, $Z_i$, where i is comprised between 1 and N (N for example being equal to 360).

Below, for the sake of clarity of the present description, the desired outline C3 will be considered to be centered on the central axis A1.

Moreover, attention will more precisely be given to the case where the ophthalmic lens must be trimmed so as to be able to fit into a frame of a full-rimmed spectacle frame.

Prior to the trimming of the ophthalmic lens 100, the latter is placed between the shafts 202, 203 of the grinder, such that its central axis A1 is coincident with the axis of these shafts.

According to the invention, the trimming of the ophthalmic lens 100 is then carried out in at least three steps, namely:

- a step of pre-roughing of the ophthalmic lens 100 along a preliminary outline C1, C1' separate from the initial outline Co and from the desired outline C3, and which is deduced from the desired outline C3 by means of an enlarging operation of the latter;
- a step of roughing the ophthalmic lens 100, along an outline C2, C3 coincident with or enlarged relative to the desired outline C3, by steering the roughing abrasive wheel 210 such that it exerts a radial force (relative to the blocking axis A7) on the edge face 105 of the lens comprised between 0.1 and 5 newtons; and
- a step of finishing the ophthalmic lens 100.

Preferably, the trimming process also comprises a subsequent polishing step.

1st Embodiment

There are various ways of implementing these four machining steps.

First, in a first embodiment of this process, the optician will be considered to have at his/her disposal a grinder 200 of the type shown in FIG. 1.

The geometric characteristics of the ophthalmic lens will also be considered to have been obtained, for example in the form of an electronic file, by him/her such that the control unit 251 has stored in memory the thickness at the center of the lens, the thickness of the film 102, and a map of the front face 103 and the back face 104 of the lens.

Figure 4A:
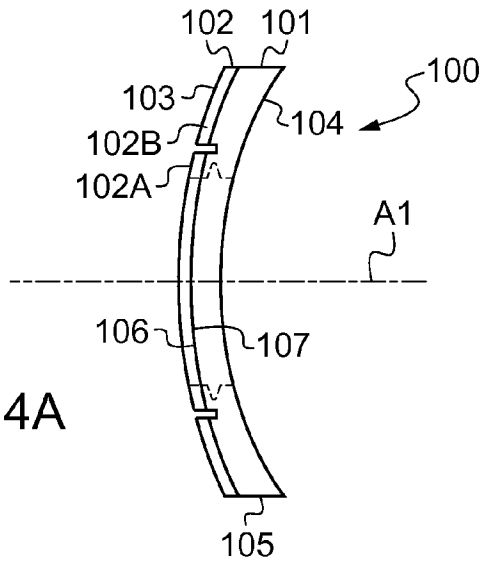
FIGS. 4A and 4B are side and front schematic views of the ophthalmic lens shown in FIGS. 3A and 3B, such as it is after a pre-roughing step carried out using a trimming process according to a first embodiment of the invention.
Figure 4B:
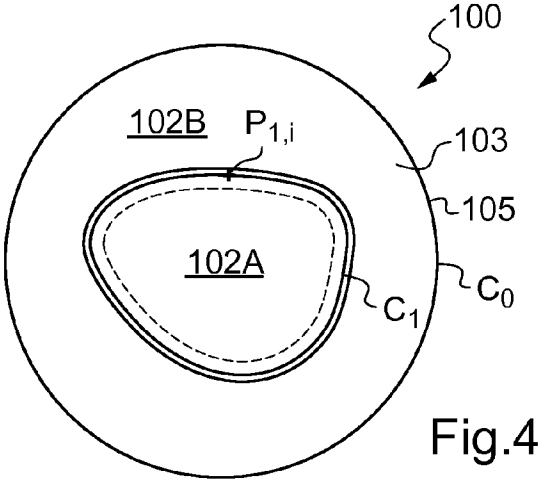

Next, in the pre-roughing step, the control unit 251 steers in coordination the pivoting movement of the block 224, the pivoting movement of the finishing module 220, the restituting movement of the rocker 201 and the rotating movement of the shafts 202, 203 such that the cutter 223 cuts via its free end the ophthalmic lens 100 right through the thickness of the coating film 102 and through only some of the thickness of the substrate 101, along the preliminary outline C1 (see FIGS. 4A and 4B).

Here, the cutter is more particularly steered to machine the substrate over a depth equal to 0.2 millimeters, thereby ensuring a complete of the film 102 right through its thickness. The film 102 is thus cut into two separate portions, namely a central portion 102A and a peripheral portion 102B.

The preliminary outline C1 (which corresponds to the outline of the central portion 102A of the film 102) along which the cutter 223 is steered is, for its part, deduced from a mathematical operation of enlarging the desired outline C3. Various mathematical enlarging operations may be used, such as for example a homothetic transformation of ratio strictly larger than 1.

Here, the enlarging operation simply consists in defining the preliminary outline C1 by a plurality of points the coordinates of which are denoted ($\rho_{1,i}$, $\theta_{1,i}$, $Z_{1,i}$) and calculated in the following way:

for all i comprised between 1 and N, $\rho_{1,i}=\rho_i+k$, k being a preset constant comprised between 0.1 and 0.9 millimeters, here equal to 0.3 millimeters;

$\theta_{1,i}=\theta_i$, $Z_{1,i}=Z_i$.

Figure 5A:
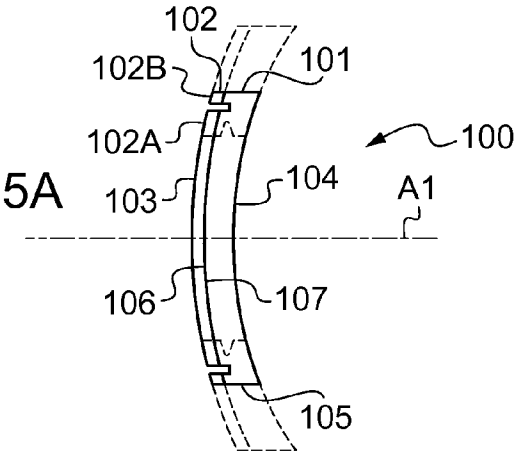
FIGS. 5A and 5B are side and front schematic views of the ophthalmic lens shown in FIGS. 4A and 4B, such as it is after a roughing step carried out according to the first embodiment of the trimming process according to the invention.
Figure 5B:
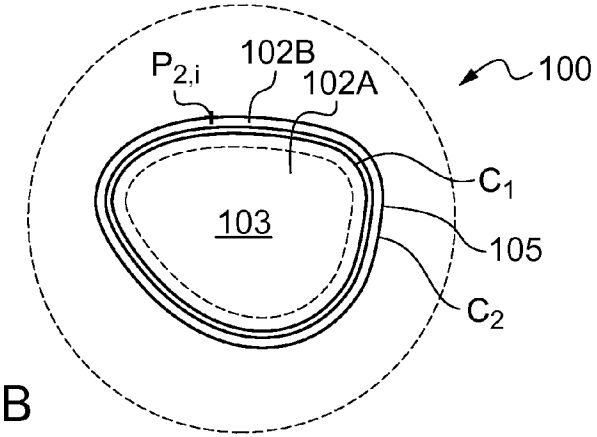

For the roughing of the ophthalmic lens 100, the roughing abrasive wheel 210 (the grain size of which is equal to 300 microns) is used in order to grind the initially circular outline Co of the lens to the shape of an intermediate outline C2 close to the desired outline C3 (see FIGS. 5A and 5B).

This intermediate outline C2 is deduced from a mathematical operation of enlarging the desired outline C3, which is such that the intermediate outline C2 is separate from and encircles the preliminary outline C1.

Here again, the enlarging operation simply consists in defining the intermediate outline C2 by a plurality of points $P_{2,i}$, the coordinates of which are denoted ($\rho_{2,i}$, $\theta_{2,i}$, $Z_{2,i}$) and calculated in the following way:

for all i comprised between 1 and N, $\rho_{2,i}=\rho_i+s$, s being a preset constant larger than k, here equal to 0.6 millimeters;

$\theta_{2,i}=\theta_i$, $Z_{2,i}=Z_i$.

In practice, the abrasive wheel 210 and the rocker 201 are then steered relatively to each other so as to decrease, for each angular position of the lens about the clamping axis A7, the length of the radius of the lens to a length equal to the radius $\rho_{2,i}$, which is strictly greater than the radius $\rho_{1,i}$.

Thus, in the roughing step, the stresses applied by the roughing abrasive wheel 210 to the ophthalmic lens 100 propagate in the film 102 as far as the trench machined by the cutter and do not reach the central portion 102A of the film 102, thereby making it possible to prevent any delamination of the central portion 102A of the film 102.

Here, one and only one pass of the roughing abrasive wheel 210 around the ophthalmic lens 100 is carried out in this roughing step.

This roughing operation is here carried out in the presence of a lubricant, for example in the presence of water, so as to decrease the amount of dust generated by machining of the lens, to prevent the roughing abrasive wheel 210 from becoming fouled, and to limit the odors given off.

Figure 6A:
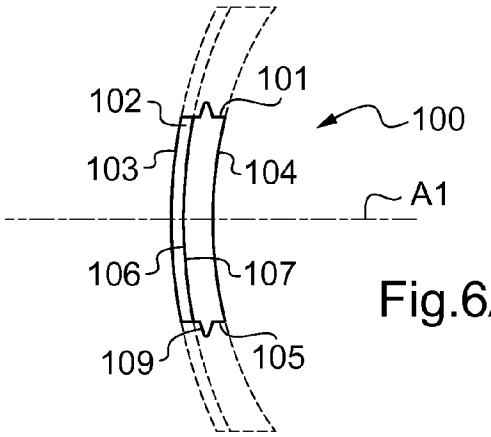
FIGS. 6A and 6B are side and front schematic views of the ophthalmic lens shown in FIGS. 5A and 5B, such as it is after a finishing step.
Figure 6B:
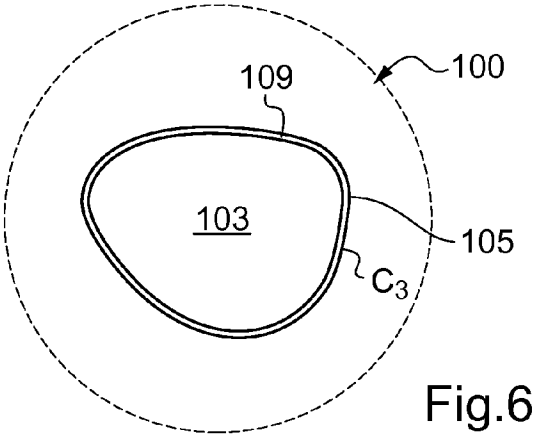

For the finishing of the ophthalmic lens 100, the beveling abrasive wheel 211 (the grain size of which is equal to 60 microns) is used in order to grind the intermediate outline C2 of the ophthalmic lens to the desired outline C3, while forming the bevel 109 on the field 105 of the lens (see FIGS. 6A and 6B). In this step, the grinder 200 is then steered so that the radial force applied by the beveling abrasive wheel 211 to the ophthalmic lens 100 remains invariably equal to a constant comprised between 5 and 18 newtons, here equal to 10 newtons.

The combination of grain size and radial force used in this step then makes it possible to prevent any delamination of the ophthalmic lens 100.

In practice, the beveling wheel 211 and the rocker 201 are then steered relatively to each other so as to decrease, for each angular position of the lens about the clamping axis A7, the length of the radius of the crest of the bevel 109 of the lens to a length equal to the radius $\rho_i$.

Here, this finishing step is carried out in three passes of the beveling abrasive wheel 211 around the ophthalmic lens 100, in the presence of water.

It will be understood that this step allows the traces left by the pre-roughing operation, and especially the trench machined by the cutter, to be removed.

For the polishing of the field 105 of the ophthalmic lens 100, the polishing abrasive wheel 213 (the shape of which is identical to that of the beveling abrasive wheel 211 and the grain size of which is equal to 5 microns) is used. The grinder 200 is then steered so that the radial force applied by the polishing abrasive wheel 213 to the ophthalmic lens 100 here remains invariably equal to a constant comprised between 10 and 35 newtons, here equal to 20 newtons.

The combination of grain size and radial force used in this step makes it possible here to prevent any delamination of the ophthalmic lens 100.

Here, this finishing step is carried out in three passes of the beveling abrasive wheel 211 around the ophthalmic lens 100, in the presence of water.

Once polished, the lens 100 is then extracted from the grinder 200 using the translational mobility of the second shaft 203, and then is fitted into the corresponding rim of the selected spectacle frame.

2nd Embodiment

In a second embodiment of this process according to the invention, the optician will be considered to have at his/her disposal a grinder 200 of the type shown in FIG. 2.

It will be understood that he or she will then be unable to implement the pre-roughing step in the same way as above as this grinder does not have a cutter.

For the pre-roughing of the ophthalmic lens 100, the roughing abrasive wheel 210 (the grain size of which is equal to 300 microns) is used in order to grind the initially circular outline Co of the lens to a shape close to the desired outline C3, which is referred to as the preliminary outline C1' and which is enlarged relative to the desired outline C3 (see FIGS. 7A and 7B). The grinder 200 is then steered so that the radial force applied by the roughing abrasive wheel 210 to the ophthalmic lens 100 remains invariably equal to a value comprised between 0.1 and 5 newtons, here equal to 2.5 newtons.

Here again, the operation of enlarging the desired outline C3 in order to obtain the preliminary outline C1' consists in calculating the coordinates ($\rho_{3,i}$, $\theta_{3,i}$, $Z_i$) of a plurality of points $P_{3,i}$ in the following way:

for all i comprised between 1 and N, $\rho_{3,i}=\rho_i+t$, t being a preset constant comprised between 1 and 2 millimeters, here equal to 1.5 millimeters;

$\theta_{3,i}=\theta_i$, $Z_{3,i}=Z_i$.

In practice, the roughing abrasive wheel 210 and the rocker 201 are then steered relatively to each other so as to decrease, for each angular position of the lens about the clamping axis A7, the radius of the lens to a length equal to the radius $\rho_{3,i}$.

Here, this pre-roughing step is carried out in a single pass of the roughing abrasive wheel 210 around the ophthalmic lens 100, in the presence of water.

The combination of grain size and radial force used in this step makes it possible to prevent as well as possible the effect of delamination of the ophthalmic lens 100.

However, this combination does not completely prevent the appearance of delamination along the preliminary outline C1'. It is for this reason that this pre-roughing step is not continued as far as the desired outline C3, and that it stops a distance away from the latter so that the delamination does not reach the desired outline C3.

Here too, the presence of water makes it possible to decrease the amount of dust generated by machining of the lens, to prevent the roughing abrasive wheel 210 from becoming fouled, and to limit the odors given off.

For the roughing of the ophthalmic lens 100, the roughing abrasive wheel 210 (the grain size of which is equal to 300 microns) is again used in order to grind the outline of the lens to the desired outline C3 (see FIGS. 8A and 8B). The grinder 200 is then steered so that the radial force applied by the roughing abrasive wheel 210 to the ophthalmic lens 100 remains invariably equal to a value comprised between 0.1 and 5 newtons, here equal to 2.5 newtons.

In practice, the roughing abrasive wheel 210 and the rocker 201 are then steered relatively to each other so as to decrease, for each angular position of the lens about the clamping axis A7, the radius of the lens to a length equal to the radius $\rho_i$.

Here, this roughing step is carried out in a single pass of the roughing abrasive wheel 210 around the ophthalmic lens 100, in the absence of lubricant.

As was seen for the pre-roughing step, the combination of grain size and radial force used in this step makes it possible to prevent as well as possible the effect of delamination of the ophthalmic lens 100. The absence of lubricant then allows the appearance of this effect to be completely prevented.

The amount of dust generated and the odors emitted by machining of the lens are then very insubstantial, since the amount of material to be machined between the preliminary outline C1' and the desired outline C3 is small.

Finishing and polishing steps are then carried out in the same way as in the aforementioned first embodiment of the invention.

The present invention is in no way limited to the embodiments described and shown, and those skilled in the art will be able to make modifications thereto without departing from the scope of the invention.

In particular, in the case where the spectacle frame is a half-rimmed frame and where the grinder is of the type shown in FIG. 1, the finishing step will comprise:

- a first operation of machining the lens along the desired contour by means of the roughing abrasive wheel, in the absence of lubricant (so that the lens has the shape shown in FIG. 8A); and then
- a grooving second operation, consisting in producing along the field of the ophthalmic lens a groove by means of the small grooving abrasive wheel with which the finishing module of the grinder is equipped.

In the case where the spectacle frame is a rimless frame and where the grinder is of the type shown in FIG. 1, the finishing step will comprise:

- a first operation of machining the lens along the desired contour by means of the roughing abrasive wheel, in the absence of lubricant (so that the lens has the shape shown in FIG. 8A); and then
- a drilling second operation, consisting in producing holes drilled through the lens, by means of the cutter, so as to make it possible to fix therein the pins of the temples and of the bridge of the spectacle frame.

According to another variant of the invention, in one and/or another of the pre-roughing, roughing, finishing and polishing steps, the force applied by the abrasive wheel to the ophthalmic lens will possibly be varied over a small interval of values. Thus:

- in the pre-roughing and/or roughing steps using the roughing abrasive wheel, provision will possibly be made for the radial force applied by this abrasive wheel to the ophthalmic lens to vary between 0.1 and 5 newtons;
- in the finishing step using the beveling abrasive wheel, provision will possibly be made for the radial force applied by this abrasive wheel to the ophthalmic lens to vary between 5 and 18 newtons; and
- in the polishing step using the polishing abrasive wheel, provision will possibly be made for the radial force applied by this abrasive wheel to the ophthalmic lens to vary between 10 and 35 newtons.

The invention claimed is:

1. A process for trimming an ophthalmic lens along a desired outline, said ophthalmic lens comprising a substrate and at least one coating film that is made of a different material to that of the substrate and that covers a main face of the substrate, comprising:

- a step of pre-roughing the ophthalmic lens by means of a preliminary tool, along a preliminary outline separate and deduced from said desired outline;
- a step of roughing the ophthalmic lens by means of a roughing abrasive wheel, along a roughing outline coincident with or enlarged relative to the desired outline; and
- a step of finishing the ophthalmic lens by means of a finishing tool,
- wherein said preliminary outline is enlarged relative to the desired outline and the roughing abrasive wheel used has a grain size between 0.1 millimeter and 0.5 millimeter and is pushed on said ophthalmic lens so as to apply, in said roughing step, a radial force between 0.1 Newton and 5 Newton to the ophthalmic lens.

2. The trimming process as claimed in claim 1, in which said finishing tool used is an abrasive wheel having a grain size between 0.02 millimeter and 0.1 millimeter, is pushed on said ophthalmic lens along the desired outline, so as to apply, in said finishing ste, a radial force between 5 Newton and 18 Newton to the ophthalmic lens.

3. The trimming process as claimed in claim 1, in which, in said finishing step, said finishing tool is pushed on said ophthalmic lens in order to machine said ophthalmic lens in at least three passes.

4. The trimming process as claimed in claim 1, in which, after said finishing step, a step of polishing said ophthalmic lens by means of a polishing tool is provided.

5. The trimming process as claimed in claim 4, in which said polishing tool used is an abrasive wheel having a grain size comprised between 0.0005 millimeter and 0.02 millimeter, pushed on said ophthalmic lens so as to apply, in said polishing ste, a radial force 10 Newton and 35 Newton to the ophthalmic lens.

6. The trimming process as claimed in claim 4, in which, in said polishing step, said polishing tool is pushed on said ophthalmic lens in order to machine said ophthalmic lens in at least three passes.

7. The trimming process as claimed in claim 1, in which, said preliminary tool being a cutter, during said pre-roughing step, the ophthalmic lens is cut right through the thickness of the coating film and through only some of the thickness of the substrate, along the preliminary outline.

8. The trimming process as claimed in claim 7, in which the roughing outline is enlarged relative to the preliminary outline.

9. The trimming process as claimed in claim 7, in which said roughing step is carried out in the presence of a lubricant.

10. The trimming process as claimed in claim 1, in which, said preliminary tool consisting of said roughing abrasive wheel, said pre-roughing step is carried out in the presence of a lubricant, along the preliminary outline.

11. The trimming process as claimed in claim 10, in which said roughing step is carried out dry, in the absence of lubricant, along the desired outline.

* * * * *